US010188163B2

(12) United States Patent
Baschak et al.

(10) Patent No.: US 10,188,163 B2
(45) Date of Patent: Jan. 29, 2019

(54) DOUBLE-LAYER TRIM PIECE

(71) Applicant: NIKE, Inc., Beaverton, OR (US)

(72) Inventors: Kim Baschak, Portland, OR (US); Christian Darby, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1064 days.

(21) Appl. No.: 14/542,147

(22) Filed: Nov. 14, 2014

(65) Prior Publication Data

US 2016/0135528 A1 May 19, 2016

(51) Int. Cl.

| | |
|---|---|
| ***A41D 27/24*** | (2006.01) |
| ***A41F 9/00*** | (2006.01) |
| ***A41B 9/14*** | (2006.01) |
| ***A41C 3/12*** | (2006.01) |

(52) U.S. Cl.

CPC ..... *A41D 27/24* (2013.01); *A41B 9/14* (2013.01); *A41C 3/12* (2013.01); *A41F 9/00* (2013.01)

(58) Field of Classification Search

CPC ..... A41D 27/24; A41B 9/14; A41C 3/12
See application file for complete search history.

(56) References Cited

U.S. PATENT DOCUMENTS

| | | | | |
|---|---|---|---|---|
| 1,674,361 | A * | 6/1928 | Gstalder | A42B 1/22 2/175.4 |
| 1,973,849 | A * | 9/1934 | Erlanger | A41B 9/04 2/404 |
| 2,072,542 | A | 3/1937 | Busch et al. | |
| 2,106,075 | A * | 1/1938 | Tabley | A42C 5/02 2/181 |
| 2,159,615 | A | 5/1939 | Kaak | |
| 2,190,560 | A | 2/1940 | Gaines | |
| 2,377,933 | A * | 6/1945 | Glass | D06M 17/00 156/212 |
| 2,411,175 | A | 11/1946 | Wagler | |
| 2,910,853 | A | 11/1959 | Howard | |
| 2,960,855 | A | 11/1960 | Siciliano | |
| 3,710,599 | A | 1/1973 | Sarmiento | |
| 3,761,962 | A * | 10/1973 | Myers | A41D 27/28 2/227 |
| 5,481,760 | A * | 1/1996 | Wood, Jr. | A42B 1/061 2/181.4 |

(Continued)

FOREIGN PATENT DOCUMENTS

| | | |
|---|---|---|
| CN | 200996096 Y | 12/2007 |
| DE | 8714312 U1 | 12/1987 |

(Continued)

OTHER PUBLICATIONS

International Preliminary Report on Patentability dated May 26, 2017 for International Patent Application No. PCT/US2015/059406, 10 pages.

(Continued)

*Primary Examiner* — Richale Quinn
(74) *Attorney, Agent, or Firm* — Shook, Hardy & Bacon L.L.P.

(57) ABSTRACT

A knit or woven article of unitary construction for forming a double-layer trim piece is provided. The article includes a first zone having a first set of apertures, a second zone having a second set of apertures, and a third zone interposed between the first zone and the second zone.

19 Claims, 6 Drawing Sheets

(56) References Cited

U.S. PATENT DOCUMENTS 5,769,838 A * 6/1998 Buell ..... A61F 13/49009 604/358
6,120,487 A * 9/2000 Ashton ..... A61F 13/49009 604/358
6,131,202 A * 10/2000 Yan ..... A42B 1/22 2/181
6,276,177 B1 8/2001 West
6,276,178 B1 8/2001 West et al.
7,131,148 B1 * 11/2006 Traumer ..... A42B 1/041 2/426
7,278,173 B2 * 10/2007 Turner ..... A42B 1/06 2/181
D578,742 S * 10/2008 Cho ..... D2/894
7,581,258 B2 * 9/2009 Baron ..... A41D 31/0033 2/168
8,166,772 B2 * 5/2012 Cho ..... A42B 1/008 62/259.3
2004/0040070 A1 3/2004 Wong
2009/0055998 A1 * 3/2009 Blumenfeld ..... A41B 9/14 2/403
2011/0191938 A1 * 8/2011 Elliott ..... A42C 5/02 2/181.2
2012/0045967 A1 * 2/2012 Punsal ..... A41C 3/0057 450/82
2014/0196196 A1 * 7/2014 Lee ..... A41B 9/14 2/400
2014/0331385 A1 11/2014 Okies et al.
2015/0152578 A1 * 6/2015 Darby ..... D04B 1/243 66/171

FOREIGN PATENT DOCUMENTS

DE 102005041599 A1 3/2007
EP 2430224 B1 9/2015
FR 2752682 A1 3/1998
JP 2004100130 A 4/2004
KR 100832080 B1 5/2008
NL 1604455 A 11/1976
WO 2004008892 A1 1/2004
WO 2005000055 A1 1/2005
WO 2014117052 A1 7/2014

OTHER PUBLICATIONS

International Search Report with Written Opinion dated Jan. 19, 2016 in Application No. PCT/US2015/059406, 14 pages.

* cited by examiner

DOUBLE-LAYER TRIM PIECE

CROSS-REFERENCE TO RELATED APPLICATIONS

Not Applicable.

TECHNICAL FIELD

The present disclosure relates to a double-layer trim piece. More particularly, the present disclosure relates to a double-layer trim piece, such as a waistband or an underband of a sport bra, formed by folding a unitary knit or woven article along its longitudinal axis.

BACKGROUND

Typical trim piece assemblies, such as a waistband assembly or an underband assembly, are often constructed from multiple pieces of material. The number of steps required to assemble the multiple pieces of material into the trim piece increases production costs. Further, each assembly step introduces an opportunity for error and impaired quality control. Use of multiple pieces of material also introduces points of structural weakness to the trim piece at each point of attachment (e.g., a seam or junction) between the different pieces. This, in turn, makes the trim piece particularly prone to wear and tear. Each piece of material, moreover, must be cut to match a pattern, resulting in waste.

SUMMARY

This Summary is provided to introduce a selection of concepts in a simplified form that are further described below in the Detailed Description. This Summary is not intended to identify key features or essential elements of the claimed subject matter, nor is it intended to be used as an aid in determining the scope of the claimed subject matter. The present invention is defined by the claims.

Construction and assembly of a double-layer trim piece from a unitary knit or woven textile may reduce the number of assembly steps required during manufacture. Additionally, the use of a single textile reduces the number of separate pieces required to create the final clothing article, reduces material waste during production, and minimizes assembly points (e.g., seams) which may exhibit weakness or be especially prone to wear. The use of fewer assembly points may increase comfort to a wearer, as well. The single textile may further be manipulated to add structure and/or breathability to a garment, or form additional features of the trim piece, such as a channel for holding a drawstring or apertures to facilitate breathability. The choice and selection of materials used to construct the single textile, as well as other material treatments, may increase the comfort and safety of a wearer and/or promote durability of the waistband.

At a high level, aspects herein relate to a double-layer trim piece formed from a unitary knit or woven textile article. The double-layer trim piece may comprise, for example, a waistband, or an underband of a sport bra. The knit or woven article may include three zones: a first zone having a first set of apertures, a second zone having a second set of apertures, where both the first and second sets of apertures are created by the knit or weave, and a third zone interposed between the first and second zones and that is used to facilitate folding the article to form the double-layer trim piece. In some exemplary aspects, the third zone is devoid of apertures. In an as-used arrangement, the trim piece comprises two layers formed when the unitary article is folded in a lengthwise fashion along a hypothetical axis extending longitudinally along the length of the third zone. After folding, the first zone overlays the second zone and, by extension, the first set of apertures overlay the second set of apertures; such a configuration creates the two layers of the trim piece. The size, shape, and configuration of the overlaying apertures may promote moisture transport and/or heat transfer during wear.

BRIEF DESCRIPTION OF THE DRAWINGS

The present invention is described in detail herein with reference to the attached drawing figures, wherein.

DETAILED DESCRIPTION

Aspects hereof provide for an article of unitary construction that may be folded longitudinally and affixed in part to form a double-layer trim piece having moisture transport, heat transfer, and/or air circulation qualities that improve the comfort of the wearer. Each layer of the double-layer trim piece includes a plurality of openings or apertures that facilitate the moisture transport, heat transfer, and/or air circulation characteristics of the trim piece. Additionally, a portion of the folded region may be bonded or stitched to provide an element of structural reinforcement to the trim piece. A channel, moreover, may be formed in one of the layers that may be used to hold a drawstring by which, for example, a waistband formed from the article of unitary construction can be tightened or loosened.

In one aspect, an article of unitary construction for forming a double-layer trim piece is described. The article comprises a first zone having a first set of apertures, each of the first set of apertures having a first size. The article further comprises a second zone having a second set of apertures that may be of a same or different size as compared to the first set of apertures. The article also comprises a third zone interposed between the first and second zones where the third zone is used for folding the article such that the first zone overlays the second zone in an as-used configuration.

In the following figures, articles are depicted in accordance with aspects of the present invention. The articles depicted herein are only a few examples of suitable articles and are not intended to suggest any limitation as to the scope of use or functionality of the invention. Neither should the articles be interpreted as having any dependency or requirement relating to any one or combination of elements or characteristics illustrated therein. Although some elements are shown in the singular, they may be plural. Additionally, although some elements are depicted as plural in occurrence, in actuality, they may be singular.

Figure 1:
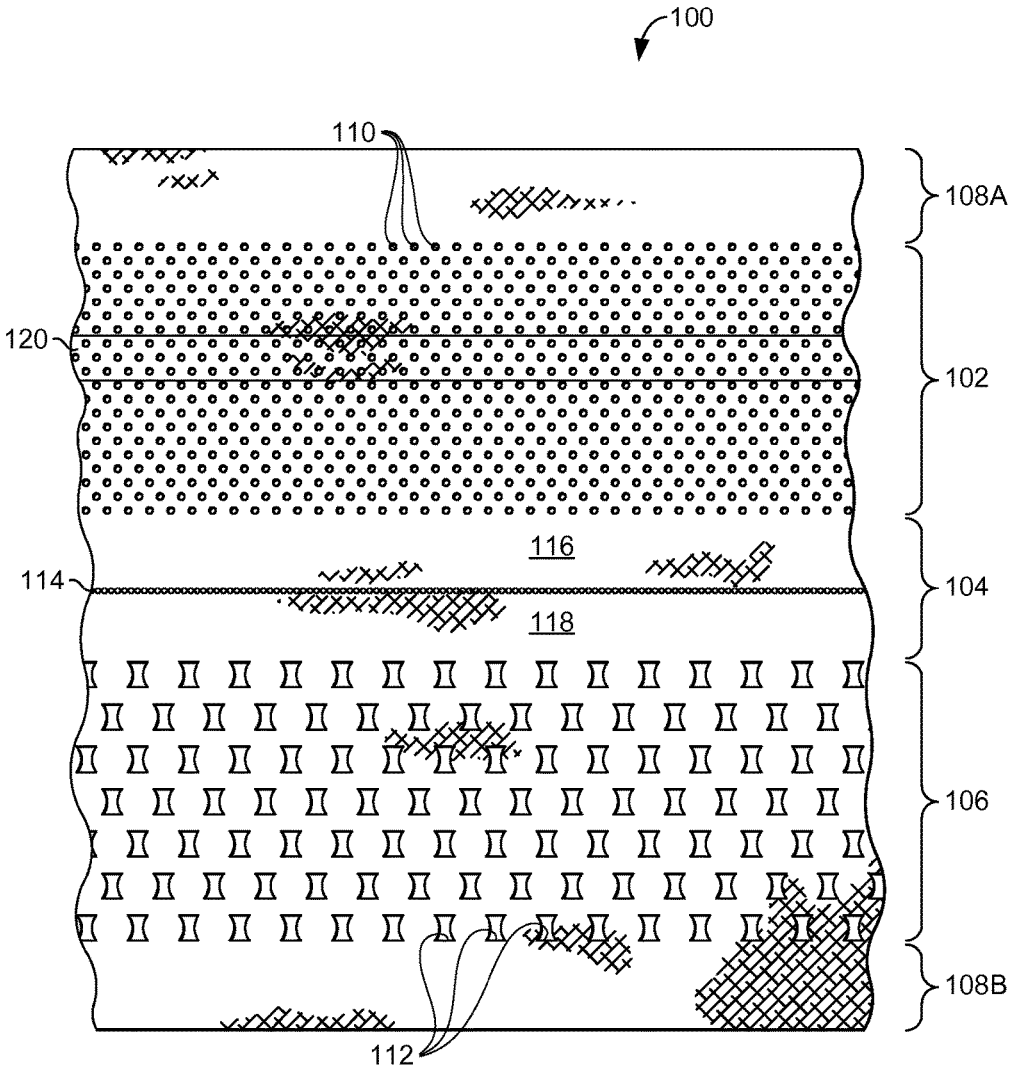
FIG. 1 depicts a top plan view of a portion of an article of unitary construction for forming a double-layer trim piece, in accordance with an aspect hereof.

Referring now to FIG. 1, a top plan view of a portion of an article 100 of unitary construction for forming a double-layer trim piece is shown, in accordance with an aspect hereof. Although only a portion of the article 100 is shown in FIG. 1, it is contemplated that the article 100 may be of a specified length sufficient to encircle, for example, the torso of a wearer when the article 100 is formed into the double-layer trim piece. As such, the article 100 may include a first end, a second end, and an intervening portion disposed between the first end and the second end. The double-layer trim piece formed from the article 100 may be incorporated into a garment or attached to other pieces of material to form a complete garment. Exemplary articles may include pants (e.g., running pant or yoga pant), capris, shorts, skirts (e.g., tennis skirt), sport bras, athletic camisoles, and the like.

As shown in FIG. 1, the article 100 includes a first zone 102, a second zone 106, and a third zone 104 interposed between the first zone 102 and the second zone 106. The article 100 may be formed by a weaving or a knitting process that utilizes a plurality of filaments, fibers, and/or yarns to integrally form the first, second, and third zones 102, 106, and 104 respectively. In aspects, the filaments may comprise polyester filaments and spandex filaments although other types of filaments are contemplated herein such as nylon, elastane, viscose, cotton, and combinations thereof. In an exemplary aspect, the article 100 may be formed using approximately 67% polyester filaments and 33% spandex filaments although other ratios are contemplated herein. Use of these types of filaments in this ratio may facilitate rapid evaporation of moisture from the article 100 thereby increasing wearer comfort. Further, use of these types of filaments may impart elastic characteristics (e.g., two-way stretch and/or four-way stretch) and superior shape retention and memory to the article 100 while maintaining structural integrity of the article 100. Further, the article 100 and/or the materials used to form the article 100 may be treated and/or coated to be fade-resistant, mildew resistant, stain resistant, and easy to clean.

Continuing, the article 100 and corresponding double-layer trim piece may be formed so as to be of a uniform color throughout (e.g., the first, second, and third zones may all be the same color). In other words, the filaments used to knit or weave the article 100 may be the same color. Alternatively, the article 100 may be constructed such that the first zone 102 may be formed using filaments of a first color, and the second zone 106 may be formed using filaments of a second color that is different from the first color. In this aspect, the half of the third zone 104 abutting the first zone 102 may be formed using filaments of the first color, and the half of the third zone 104 abutting the second zone 106 may be formed using filaments of the second color. The transitions between the filaments of the first color and the filaments of the second color may occur at a hypothetical axis that longitudinally bisects the third zone 104 into the two halves. The result of this process is that when the trim piece is in an as-constructed arrangement, an outer-facing surface of the trim piece may be the first color and the inner-facing surface of the trim piece may be the second color, or vice versa. In another exemplary aspect, graphics may be applied to the article 100 in a post-processing step. The graphics may be applied using, for example, ink-jet printing and/or pad printing. In another post-processing step, silicone bands or strips may be applied longitudinally to a surface of the first zone 102 or the second zone 106. The silicone bands may be applied to the surface which will ultimately comprise the surface which faces the wearer's skin when the article 100 is formed into the trim piece. This may help, for example, to prevent a shirt tucked into a waistband formed from the article 100 from becoming untucked. When the article 100 is used to form an unberband of a sport bra, the silicone bands may help the underband of the sport bra to remain in place when worn.

In an exemplary aspect, the first zone 102 may include a first perimeter band 108A extending longitudinally along a length of the article 100 and positioned at a first distal edge of the article 100. The second zone 106 may also include a second perimeter band 108B extending longitudinally along the length of the article 100 and located at an opposite distal edge of the article 100. The first perimeter band 108A and the second perimeter band 108B may be formed so as to be devoid of apertures. Each of the first perimeter band 108A of the first zone 102 and the second perimeter band 108B of the second zone 106 may comprise selvedge and/or any edge finishing that prevents unraveling of the article 100. In an exemplary aspect, the first perimeter band 108A and the second perimeter band 108B may each have a width of approximately 1 centimeter, although other dimensions are contemplated herein. In use (i.e., when the third zone 104 is folded over onto itself such that the first zone 102 overlays the second zone 106), the first perimeter band 108A and the second perimeter band 108B may be affixed together via stitching, bonding, use of an adhesive, and the like. The resulting combined perimeter band 108A/108B may then be affixed to an article of clothing. In another example, the first perimeter band 108A may not be affixed or secured to the second perimeter band 108B prior to attaching the double-layer trim piece to the article of clothing. In this case, the first perimeter band 108A would be secured to the article of clothing separately from the second perimeter band 108B. Any and all such aspects, and any variation thereof, are contemplated as being within the scope herein.

In aspects, the first zone 102 is formed to include a first set of apertures 110 that extend through the entire thickness of the first zone. Each of the first set of apertures 110 is of a first size. Each of the apertures 110 may be the same size, or, alternatively, the apertures 110 may be of varying size while still staying within a general size range. The size range might include a lower threshold corresponding to a smaller aperture and an upper threshold corresponding to a larger aperture. In other words, in some aspects, the first set of apertures 110 of the first zone 102 may include apertures having more than one size associated with a size range such that an aperture-size gradient or gradation is available. For example, a first portion of the first set of apertures 110 may correspond to the lower threshold of the size range, a second portion of the first set of apertures 110 may correspond to a median of the size range, while a third portion of the first set of apertures 110 may correspond to the upper threshold of the size range, wherein each of the lower, median, and upper threshold are within and/or define the particular size range corresponding to the first size.

Continuing, in a further example, as apertures 110 are dispersed throughout the first zone 102, the size of the first set of apertures 110 may gradually change from the lower size threshold to the upper size threshold, across the first zone 102. As such, apertures 110 near the first perimeter band 108A may be larger in size than apertures near the boundary where the first zone 102 meets the third zone 104, or vice versa. Such a gradient or gradation of aperture size of the first set of apertures 110 may be directional (e.g., horizontal, vertical, radial, or another angled) and/or may occur in a repeating pattern. As shown in FIG. 1, the first set of apertures 110 may be of a same or similar shape. The shape of the first set of apertures 110 as depicted in FIG. 1 is exemplary only, and it contemplated that the first set of apertures 110 may comprise any number of shapes such as circles, squares, rectangles, triangles, ellipses, parallelograms, hexagons, teardrop-shapes, and the like. One or more of the first size, configuration, and/or a shape of the first set of apertures 110 may facilitate air circulation, heat transfer, and/or moisture transport.

The second zone 106 of the article 100 includes a second set of apertures 112 that extend through the thickness of the second zone 106. In aspects, each of the second set of apertures 112 is of a second uniform size that is not the same as the first size of the first set of apertures 110 of the first zone 102. More specifically, as shown in FIG. 1, the second set of apertures 112 may be larger in size as compared to the first set of apertures 110. The apertures 112 may also be of varying size while still staying within a general size range, where the general size range may be larger than the general size range for the first set of apertures 110. The size range might include a lower threshold corresponding to a smaller aperture and an upper threshold corresponding to a larger aperture. In other words, in some aspects, the second set of apertures 112 may include apertures having more than one size associated with a size range such that an aperture-size gradient or gradation is available. For example, a first portion of the second set of apertures 112 may correspond to the lower threshold of the size range, a second portion of the second set of apertures 112 may correspond to a median of the size range, while a third portion of the second set of apertures 112 may correspond to the upper threshold of the size range, wherein each of the lower, median, and upper threshold are within and/or define the particular size range corresponding to the second size.

As well, in a further example, as apertures 112 are dispersed throughout the second zone 106, the size of the second set of apertures 112 may gradually change from the lower size threshold to the upper size threshold across the second zone 106. As such, apertures 112 near the second perimeter band 108B may be larger in size than apertures near the boundary where the second zone 106 meets the third zone 104, or vice versa. Such a gradient or gradation of aperture size of the second set of apertures 112 may be directional (e.g., horizontal, vertical, radial, or another angled) and/or may occur in a repeating pattern. As shown in FIG. 1, the second set of apertures 112 may be of a same or similar shape. In aspects, the shape of the apertures 112 may be the same as the shape of the apertures 110, and in other aspects, the shape of the apertures 112 may be different than the shape of the apertures 110. The shape of the second set of apertures 112 as depicted in FIG. 1 is exemplary only, and it contemplated that the second set of apertures 112 may comprise any number of shapes such as circles, squares, rectangles, triangles, ellipses, parallelograms, hexagons, teardrop-shapes, and the like. One or more of the second size, configuration, and/or a shape of the second set of apertures 112 may facilitate air circulation, heat transfer, and/or moisture transport.

In exemplary aspects, at least one of the first zone 102 or the second zone 106 may be constructed so as to include an integrally woven or knit channel 120 extending along a longitudinal axis of the first zone 102 or the second zone 106 and centered on the first zone 102 or the second zone 106. Although the channel 120 is shown as part of the first zone 102 in FIG. 1, it is contemplated that the channel 120 may, instead, be part of the second zone 106. As mentioned, the channel 120 is integral to the first zone 102 or the second zone 106 in that it is formed from the same filaments used to create the first zone 102 or the second zone 106. The channel 120 is adapted to contain a drawstring that may be used to tighten or loosen, for instance, a waistband formed from the article 100 when worn by a user.

In an exemplary aspect, both the first zone 102 and the second zone 106 may have a width of approximately 2.0 cm, 3.0 cm, 4.0 cm, 5.0 cm, or any width within a range of approximately 2.0 cm to 5.0 cm. In an exemplary aspect, both the first zone 102 and the second zone 106 may have the same width. Thus, when the article 100 is formed into the waistband, the waistband may have a width of approximately 2.0 cm, 3.0 cm, 4.0 cm, 5.0 cm, or any width within a range of approximately 2.0 cm to 5.0 cm. The size of the apertures 110 and 112 may remain constant for each of these different width ranges, or, alternatively, the size of the apertures may decrease when the width of the waistband decreases and increase when the width of the waistband increases, or vice versa.

The article 100 of FIG. 1 further includes the third zone 104 interposed or formed between the first zone 102 and the second zone 106. The third zone 104 may be formed so as not to have apertures. In other words, the third zone 104 may be devoid of apertures. The third zone 104 is integrally connected to and formed from the first zone 102 and/or the second zone 106. To put it another way, the third zone 104 is constructed using the same filaments used to form the first and second zones 102 and 106. The first, second, and third zones 102, 106, and 104 may each lie in a single, sequential, and continuous plane when the article 100 is in an un-assembled configuration.

In an exemplary aspect, the third zone 104 may have a width of approximately 24 millimeters when the article 100 is in an un-assembled configuration. In an exemplary aspect, the third zone 104 may be bisected by a hypothetical axis 114 that extends longitudinally along the length of the third zone 104 and bisects the third zone 104 into a first portion 116 adjacent to the first zone 102 and a second portion 118 adjacent to the second zone 106. As well, the hypothetical axis 114 may also bisect the article 100 into two equal longitudinal halves. The hypothetical axis 114 may, in some aspects, comprise a "drop stitch zone" 114 created by dropping a made stitch at periodic intervals. The result is that the drop stitch zone 114 may have fewer filaments per unit area as compared to the remaining portion of the third zone 104. This, in turn, facilitates folding the third zone 104 along its longitudinal axis so that the first portion 116 overlays the second portion 118 of the third zone 104, and the first zone 102 overlays the second zone 106.

Figure 2:
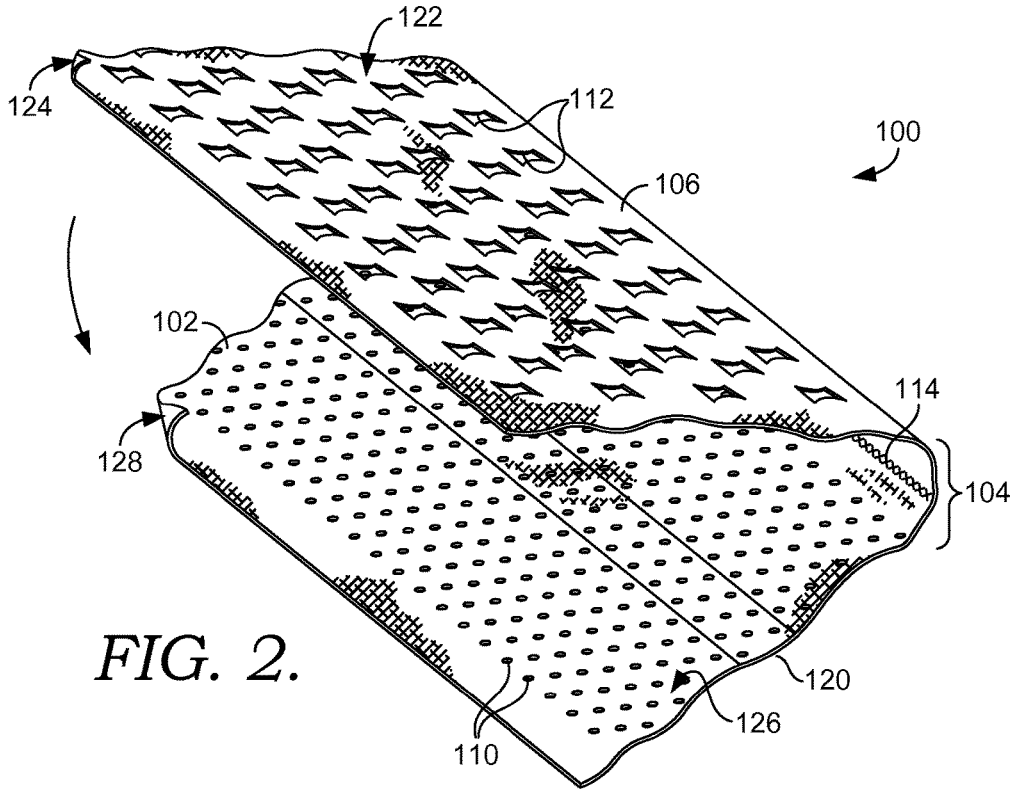
FIG. 2 depicts a side perspective view of a portion of an article of unitary construction for forming a double-layer trim piece, in accordance with an aspect hereof.

Turning now to FIG. 2, a side perspective view of the article 100 of unitary construction for forming the double-layer trim piece is illustrated, in accordance with an aspect hereof. More specifically, FIG. 2 depicts the article 100 being folded longitudinally in the direction shown by the arrow so as to create the double-layer trim piece. As shown in FIG. 2, the first zone 102 may comprise a first surface 126 and a second opposing surface 128 (shown by folding over a corner of the article 100). Similarly, the second zone 106 may comprise a first surface 124 (shown by folding up a corner of the article 100) and a second opposing surface 122.

As illustrated, the third zone 104 of the article 100 may be folded over onto itself along the longitudinal axis 114 that bisects the third zone 104 into the first portion 116 and the second portion 118. As mentioned, the bisecting longitudinal axis 114 may be a hypothetical axis or may comprise the drop-stitch zone 114. When the third zone 104 is folded as shown in FIG. 2, the first portion 116 and the second portion 118 of the third zone 104 overlay each other. In addition, the first zone 102 and the second zone 106 overlay each other thereby causing the first set of apertures 110 to overlay the second set of apertures 112. More specifically, when the third zone 104 is folded over onto itself, the first surface 126 of the first zone 102 comes into contact with the first surface 124 of the second zone 106.

Once folded, the first zone 102 might form the exterior layer or external-facing surface of the trim piece and the second zone 106 might form the interior layer or internal-facing surface of the trim piece, such that the second zone 106 is a skin-contacting layer when the trim piece is incorporated into an article of clothing that is worn by a wearer. Alternatively, the first zone 102 might form the internal-facing layer and the second zone 106 might form the external-facing layer of the trim piece. Any and all such aspects, and any variation thereof are contemplated as being within the scope herein.

Figure 3A:
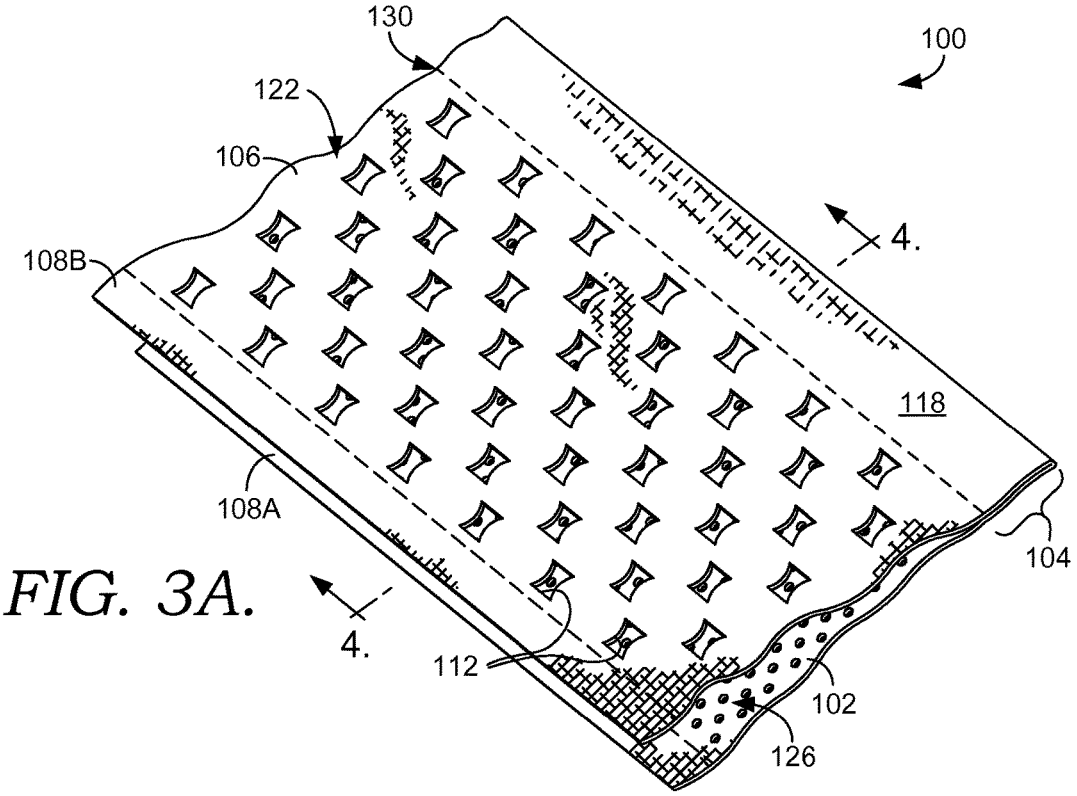
FIGS. 3A and 3B depict side perspective views of a portion of an article of unitary construction for forming a double-layer trim piece, in accordance with an aspect hereof.

FIG. 3A depicts a side perspective view of the article 100 of unitary construction for forming the double-layer trim piece, in accordance with an aspect hereof. More specifically, the article 100 is shown as being completely folded in half along the longitudinal axis 114 bisecting the third zone 104. Once folded, the first portion 116 and the second portion 118 of the third zone 104 may be affixed to each other using, for example, a hot melt adhesive, film, fusing, tape, ultrasonic bonding, and the like. In another aspect, the first portion 116 and the second portion 118 of the third zone 104 may be affixed to each other using stitching such as a chain stitch or a zig-zag stitch. The affixing of the first portion 116 to the second portion 118 by use of the affixing technologies discussed above is shown by the line 130.

In some aspects, the first portion 116 and the second portion 118 may be bonded, affixed, and/or secured to each other such that substantially no unaffixed portion of the third zone 104 remains. In another aspect, the first portion 116 and the second portion 118 of the third zone 104 may be affixed to each other such that unaffixed areas remain. This may occur, for instance, when stitching is used to affix the first portion 116 to the second portion 118. The area above the stitch line 130 (e.g., the area adjacent to the axis 114) may remain unaffixed to each other in aspects. The use of adhesives and/or stitching to affix the first portion 116 to the second portion 118 helps to provide structural reinforcement to the trim piece and prevents the first and second layers of the trim piece from each expanding outward when the trim piece is incorporated into an article of clothing.

In an exemplary aspect, the first zone 102 and the second zone 106 remain unaffixed to each other after folding. In aspects, this may create an open space or pocket between the first zone layer 102 and the second zone layer 106 once the trim piece is affixed to a clothing article via the perimeter bands 108A and 108B. The open space or pocket may aid in promoting ventilation via, for example, the apertures 110 and 112 which, in turn, may help to cool the wearer. In another exemplary aspect, the article 100 may be formed so that the first zone layer 102 and the second zone layer 106 may be loosely affixed to each other using float yarns or tie yarns. Any and all such aspects, and any variation thereof, are contemplated as being within the scope of the aspects discussed herein.

As discussed above, once folded, the first and second perimeter bands 108A and 108B may be secured to one another using affixing technologies discussed herein and then secured to a clothing article using the affixing technologies discussed herein. Alternatively, the first perimeter band 108A may be secured to the clothing article, and the second perimeter band 108B may separately be secured to the article using affixing technologies discussed herein.

Figure 3B:
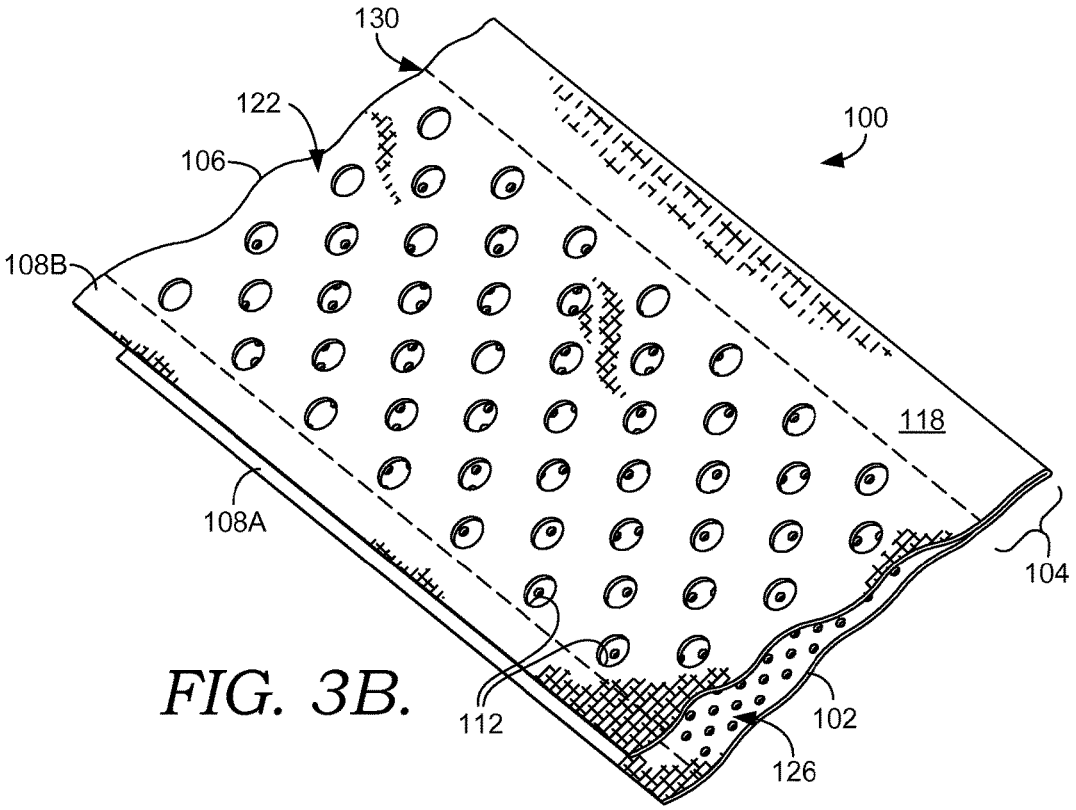

FIG. 3A illustrates the second set of apertures 112 having a somewhat rectangular appearance. Other shape configurations are contemplated herein. For instance, FIG. 3B illustrates the apertures 112 having a circular shape, where the apertures 112 have a larger size than the apertures 110. Any and all such aspects, and any variation thereof, are contemplated as being within the scope herein.

In aspects, the overlay of the first and second zones 102 and 106 and the resulting overlay of the apertures 110 and 112 may imbue the double-layer trim piece with air circulation, moisture wicking, and/or heat dissipation qualities. For example, when the trim piece is constructed such that the second zone 106 with its larger apertures 112 comprises an outer-facing surface of the trim piece and the first zone 102 with its smaller apertures 110 comprises an inner-facing surface of the trim piece, a wearer's perspiration will first be absorbed into the first zone 102. The small size of the apertures 110 of the first zone 102 creates a greater surface area per square unit as compared to the second zone 106 with its larger apertures 112. This creates a diffusion or concentration gradient between the first zone 102 and the second zone 106 which helps to transport the perspiration away from the wearer to the externally-facing second zone 106 where it can then evaporate.

In another example, and using the configuration described above where the second zone 106 comprises an outer-facing layer or surface of the trim piece and the first zone 102 comprises an inner-facing layer of the trim piece, the larger size of the apertures 112 may help to channel air from the external environment through the apertures 112 to the interior of the trim piece thus helping to cool the wearer. As seen, the differences between each set of apertures 110 and 112 whether due to shape, orientation, placement, and/or size, may be used to facilitate (e.g., increase or reduce) moisture transport, heat transfer, and/or air circulation, depending on the orientation of the overlay of the first and second zones 102 and 106.

In yet another example, the materials used to form each of the first and/or second zones 102 and 106 may have hydrophilic properties. As used throughout this application, the term "hydrophilic" and its derivatives mean having an affinity for moisture and water or readily absorbing water. The hyrdrophilic properties may be intrinsic to the materials used to form the article 100, or the hydrophilic properties may be imparted to the materials by treating the article 100 with one or more hydrophilic compositions.

In one aspect, the zone that forms the exterior layer of the trim piece (e.g., either the first zone 102 or the second zone 106) may have a greater degree of hydrophilicity than the zone that forms the interior layer of the trim piece (e.g., either the first zone 102 or the second zone 106). By having the skin-contacting zone be comprised of a hydrophilic material, moisture may be drawn away from the wearer's skin and into the material of the skin-contacting zone. Once the moisture is "trapped" by the skin-contacting zone, the large-surface area created by the apertures (either the apertures 110 or the apertures 112) helps to disperse the moisture along the entirety of the skin-contacting zone. Next, due to the skin-contacting zone (or interior layer) being less hydrophilic than the exterior zone (or exterior layer), the moisture may be transported along a hydrophilic gradient from the skin-contacting zone outward and into the exterior zone, away from a wearer's skin. Upon transport to the exterior zone, the large surface area created by the apertures again helps to disperse the moisture along the entirety of the external-facing zone. Further, the apertures on the external-facing zone facilitate increased air circulation which may speed the evaporation of the moisture from the trim piece.

Figure 4:
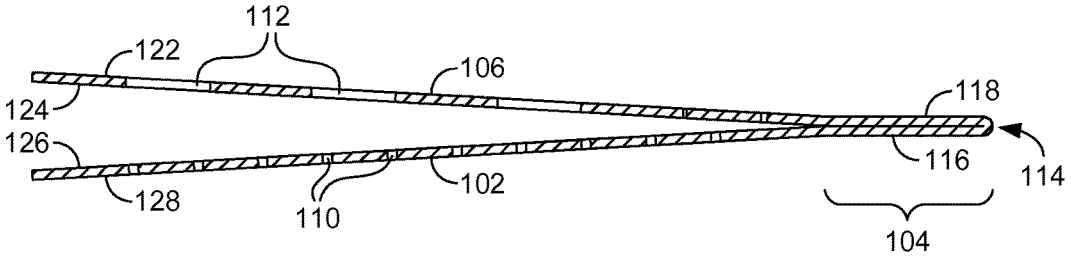
FIG. 4 depicts a cross-section taken through line 4-4 of FIG. 3A, in accordance with an aspect hereof.

FIG. 4 depicts a cross-section taken through line 4-4 of FIG. 3. As seen, once folded along the fold line 114, the first portion 116 of the third zone 104 and the second portion 118 of the third zone 104 overlay each other. In aspects, the portions 116 and 118 are secured or affixed to each other using affixing technologies discussed herein. Continuing, the first zone 102 with its apertures 110 and the second zone 106 with its apertures 112 overlay each other so that the first zone 102 forms a first layer of the double-layer trim piece and the second zone 106 forms a second layer of the double-layer trim piece. More specifically, the first surface 126 of the first zone 102 is adjacent to the first surface 124 of the second zone 106 and the second surface 128 of the first zone 102 is opposite of the second surface 122 of the second zone 106. In one aspect, the second surface 128 of the first zone 102 may form an external-facing layer and the second surface 122 of the second zone 106 may form an internal-facing layer of the trim piece when attached to a clothing article. Alternatively, the second surface 128 of the first zone 102 may form an internal-facing layer and the second surface 122 of the second zone 106 may form an external-facing layer of the trim piece when attached to a clothing article.

Figure 5:
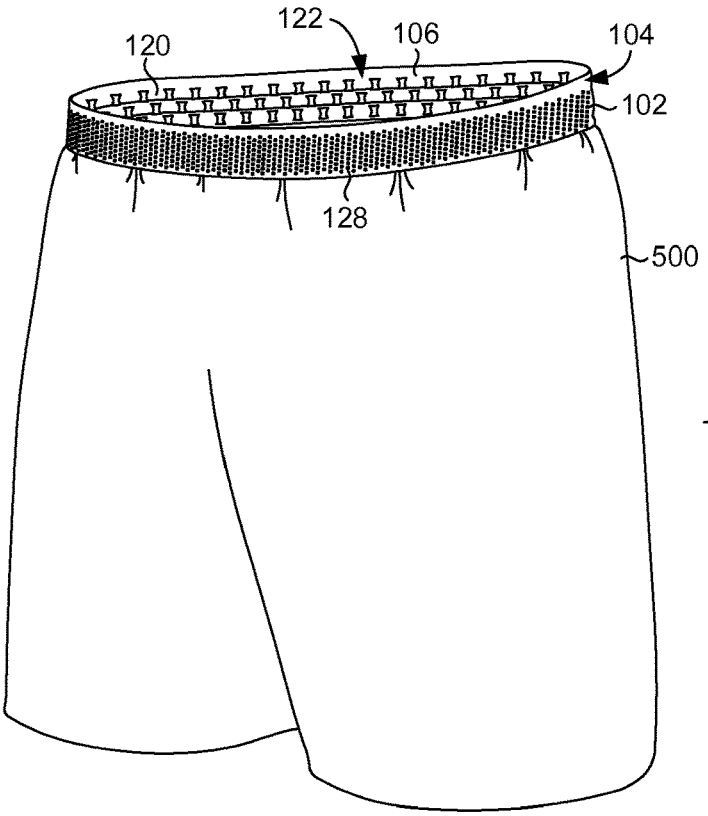
FIGS. 5-6 depict front perspective views of exemplary articles of clothing incorporating a double-layer waistband formed from an article of unitary construction, in accordance with aspects herein.

FIG. 5 depicts a front perspective view of an article of clothing 500 incorporating a double-layer waistband formed from, for example, the article 100 in accordance with an aspect hereof. The waistband of the article 500 has the first zone 102 as the external-facing layer and the second zone 106 as the internal-facing layer. The third zone 104 rises above the waistband and provides structural stability to the waistband by, for example, preventing the waistband from collapsing under its own weight. More specifically, the second surface 128 of the first zone 102 comprises the external-facing layer and the second surface 122 of the second zone 106 comprises the internal-facing layer. As such, the smaller apertures 110 are facing externally and the larger apertures 112 are adjacent to the wearer's skin when the article 500 is worn. As explained above, the first zone 102 or the second zone 106 may be formed to include an integral channel 120 for containing a drawstring (not shown in FIG. 5). With respect to the article 500, the channel 120 may be formed in the second zone 106. Such an arrangement would locate the channel 120 against the wearer's skin when the article 500 is worn and would "hide" the channel 120 from view which increases the aesthetic appeal of the article 500.

Figure 6:
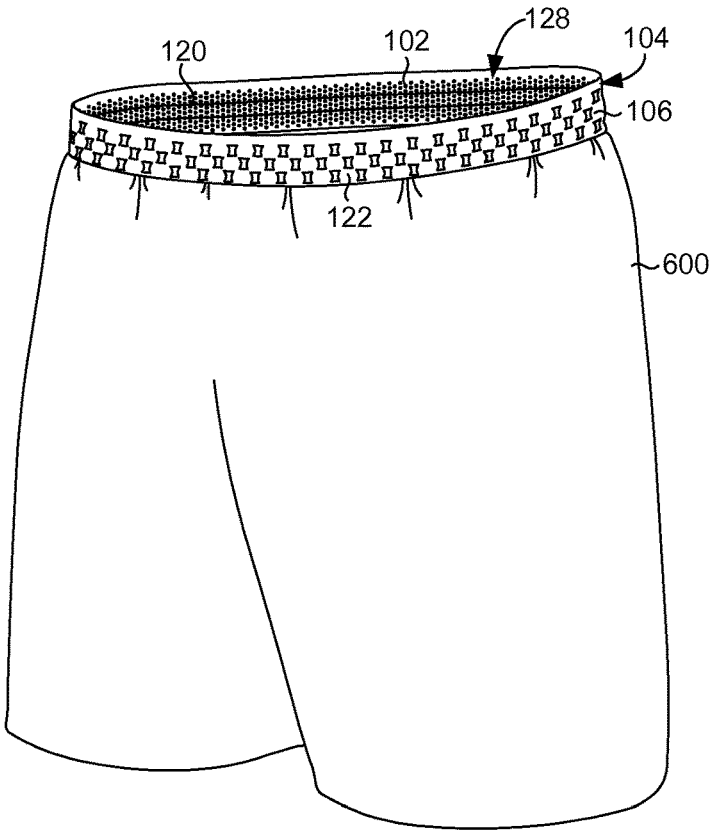

FIG. 6 depicts a front perspective view of an article of clothing 600 incorporating a double-layer waistband formed from, for example, the article 100 in accordance with an aspect hereof. The waistband of the article 600 has the first zone 102 as the internal-facing layer and the second zone 106 as the external-facing layer. The third zone 104 rises above the waistband and provides structural stability to the waistband by, for example, preventing the waistband from collapsing under its own weight. More specifically, the second surface 128 of the first zone 102 comprises the internal-facing layer that is adjacent to a wearer's skin when the article 600 is worn, and the second surface 122 of the second zone 106 comprises the external-facing surface (the surface facing the external environment). As such, the smaller apertures 110 are located on the internal-facing layer and the larger apertures 112 are located on the external-facing layer when the article 600 is worn. The article 600 may further include a drawstring contained within the channel 120 that is formed in the first zone 102. Such an arrangement would locate the channel 120 against the wearer's skin when the article 600 is worn and would "hide" the channel 120 from view which increases the aesthetic appeal of the article 600.

Figure 7:
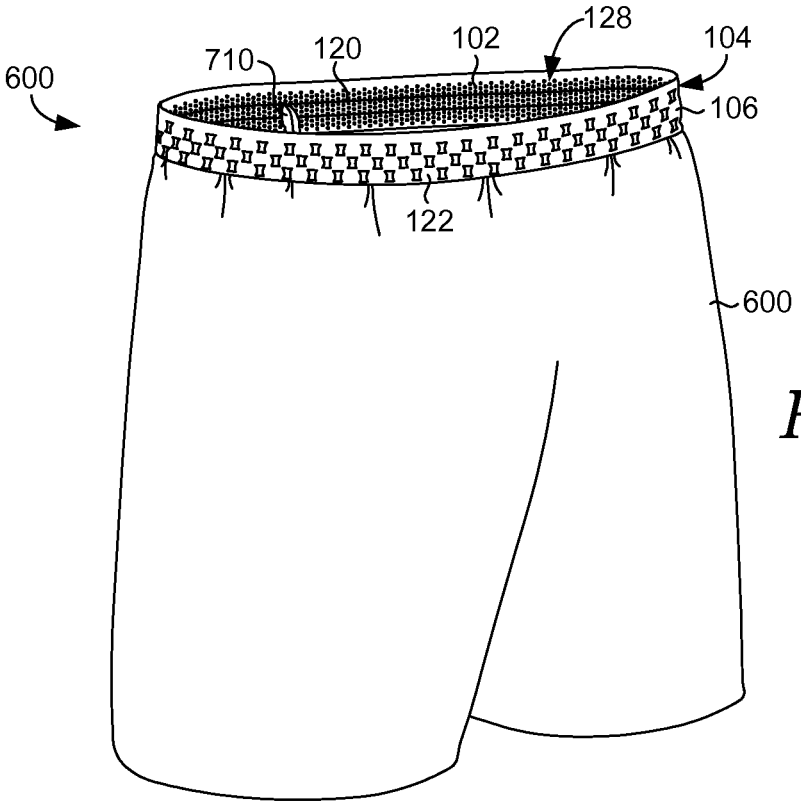
FIG. 7 depicts a back perspective view of an exemplary article of clothing incorporating a double-layer waistband formed from an article of unitary construction, in accordance with aspects herein.

FIG. 7 depicts a back perspective view of the article 600 of FIG. 6 and is used to illustrate a drawstring 710 that is contained within the channel 120. The drawstring 710 exits the waistband through an aperture located in the internal-facing first zone 102. By having the drawstring 710 on the internal-facing layer of the waistband, the drawstring can be tucked out of sight, thereby improving the aesthetic appeal of the waistband.

Figure 8:
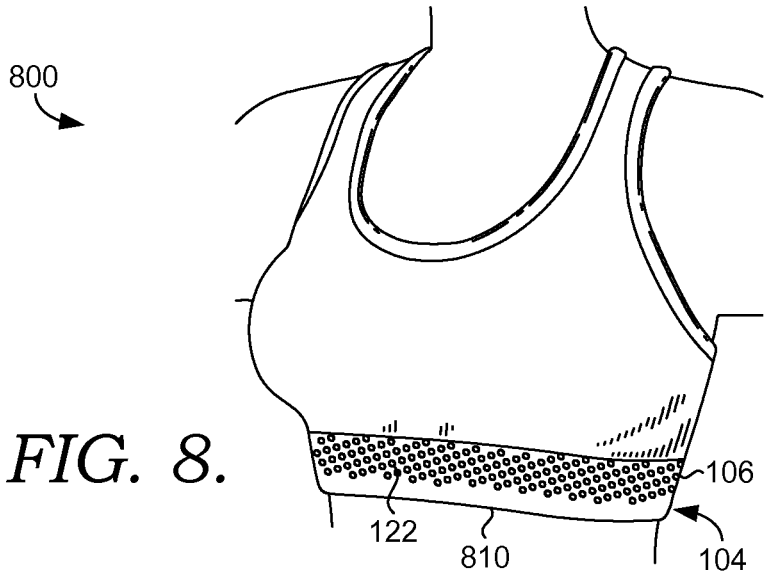
FIG. 8 depicts a front perspective view of a sport bra incorporating a double-layer underband formed from an article of unitary construction, in accordance with aspects herein.

FIG. 8 depicts a front perspective view of a sport bra 800 incorporating a double-layer underband 810 formed from, for example, the article 100 in accordance with an aspect hereof. The underband 810 comprises the lower edge of the sport bra 800 and is configured to encircle the upper torso of the wearer when the sport bra 800 is worn. The underband 810 has the first zone 102 as the internal-facing layer (not shown) and the second zone 106 as the external-facing layer. More specifically, the second surface 128 of the first zone 102 comprises the internal-facing layer that is adjacent to a wearer's skin when the article 800 is worn, and the second surface 122 of the second zone 106 comprises the external-facing surface (the surface facing the external environment). As such, the smaller apertures 110 are located on the internal-facing layer and the larger apertures 112 are located on the external-facing layer when the article 800 is worn. The third zone 104 extends below the underband 810 and provides structural stability to the underband 810.

Figure 9:
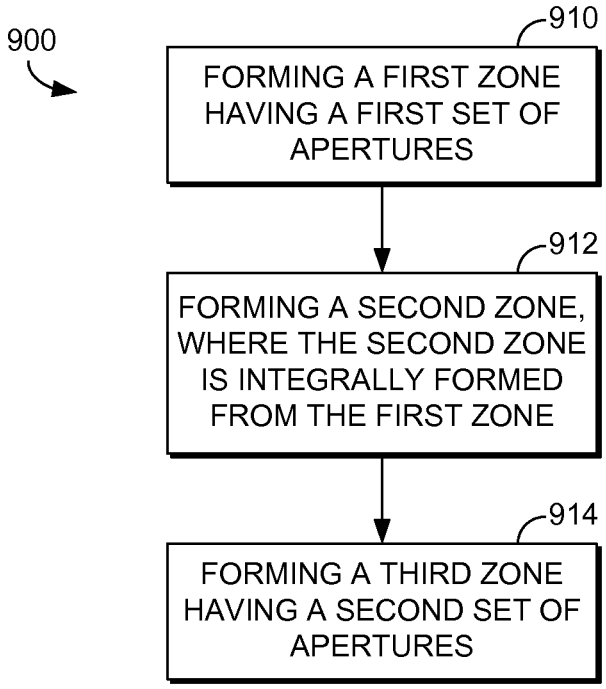
FIG. 9 depicts a flow diagram of an exemplary method of forming an article of unitary construction used for constructing a double-layer trim piece in accordance with aspects herein.

FIG. 9 depicts a flow diagram of an exemplary method 900 of forming an article of unitary construction that is used to form a double-layer trim piece. The article formed from the method 900 may comprise the article 100 discussed herein. At a step 910, a first zone having a first set of apertures may be formed using one of a knitting or weaving process. The first zone, in exemplary aspects, may comprise the first zone 102 of the article 100 and the apertures may comprise the first set of apertures 110.

At a step 912, a second zone is formed where the second zone contiguously extends from the first zone. In other words, the same filaments used to form the first zone (by either a knitting or weaving process) are also used to form the second zone. In aspects, the second zone may be formed as to be devoid of apertures. The second zone may comprise the third zone 104 of the article 100. In an exemplary aspect, the second zone may be formed to include a drop-stitch zone extending longitudinally along a hypothetical axis that bisects the second zone into two equal halves.

At a step 914, a third zone is formed having a second set of apertures. The third zone contiguously extends from the second zone. In other words, the same filaments used to form the first and second zones (by either a knitting or weaving process) may also be used to form the third zone. The second set of apertures may be the same or a larger size than the first set of apertures of the first zone. In aspects, the third zone comprises the second zone 106 of the article 100.

The method 900 may further comprise folding the second zone along the longitudinal hypothetical axis such that the first zone overlays the third zone and the first set of apertures overlays the second set of apertures. In aspects, the folded-over portions of the second zone may then be adhered or affixed to each other and the distal edges of the first and third zones may be affixed to an article of clothing such as pants, shorts, a sport bra or sport camisole, or a skirt.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made of the invention without departing from the scope thereof, it is to be understood that all matter herein set forth or shown in the accompanying drawings is to be interpreted as illustrative and not in a limiting sense.

The invention claimed is:

1. An article of unitary construction for forming a double-layer trim piece, the article comprising:

when in an un-assembled configuration:

a first zone having a first set of apertures, each of the first set of apertures having a first size;

a second zone having a second set of apertures, each of the second set of apertures having a second size; and a third zone interposed between the first zone and the second zone, wherein the first zone, the second zone, and the third zone lie in a continuous plane.

2. The article of claim 1, wherein the first size is different from the second size.

3. The article of claim 1, wherein the first zone is a different color than the second zone.

4. The article of claim 1, wherein a portion of the first zone further comprises a channel extending along a longitudinal axis of the first zone.

5. The article of claim 1, wherein the first zone includes a first perimeter band extending along a distal edge of the first zone, the first perimeter band adapted for affixing the double-layer trim piece to another article.

6. The article of claim 1, wherein the second zone includes a second perimeter band extending along a distal edge of the second zone, the second perimeter band adapted for affixing the double-layer waistband to another article.

7. The article of claim 1, wherein the third zone includes a drop-stitch zone extending along a longitudinal axis of the third zone, the drop-stitch zone bisecting the third zone along the longitudinal axis, the drop-stitch zone comprising fewer yarns per unit area relative to portions of the third zone that do not correspond to the drop-stitch zone.

8. A double-layer trim piece comprising:

a first zone having a first set of apertures, the first zone having a first surface and an opposite second surface;

a second zone having a second set of apertures, the second zone having a third surface and an opposite fourth surface; and a third zone interposed between the first zone and the second zone, the third zone longitudinally bisected by a fold line, wherein in an as-constructed arrangement, the third zone is longitudinally folded along the fold line such that the first surface of the first zone overlays the third surface of the second zone wherein the first zone, the second zone, and the third zone are of unitary construction.

9. The double-layer trim piece of claim 8, wherein the second surface of the first zone comprises an outer-facing surface of the double-layer trim piece, and the fourth surface of the second zone comprises an inner-facing surface of the double-layer trim piece when the double-layer trim piece is in the as-constructed arrangement.

10. The double-layer trim piece of claim 9, wherein the first set of apertures is a larger size than the second set of apertures.

11. The double-layer trim piece of claim 9, wherein the first set of apertures is a smaller size than the second set of apertures.

12. The double-layer trim piece of claim 8, wherein the third zone includes a first portion and a second portion such that when the third zone is longitudinally folded along the fold line, the first portion overlays the second portion.

13. The double-layer trim piece of claim 12, wherein the first portion of the third zone is affixed to the second portion of the third zone when the double-layer trim piece is in the as-constructed arrangement.

14. The double-layer trim piece of claim 12, wherein the first portion of the third zone is stitched to the second portion of the third zone when the double-layer trim piece is in the as-constructed arrangement.

15. The double-layer trim piece of claim 8, wherein the first, second, and third zones comprise a knit material, and are formed by a knitting process.

16. The double-layer trim piece of claim 8, wherein the first, second, and third zones comprise a woven material and are formed by a weaving process.

17. The double-layer trim piece of claim 8, wherein the second zone comprises a drop-stitch zone extending along a longitudinal axis of the second zone, the drop-stitch zone comprising fewer yarns per unit area relative to portions of the second zone that do not correspond to the drop-stitch zone.

18. The double-layer trim piece of claim 8, wherein the double-layer trim piece is a waistband in an as-constructed arrangement.

19. The double-layer trim piece of claim 8, wherein the double-layer trim piece is an underband of a sport bra in an as-constructed arrangement.

* * * * *